US011059039B2

(12) United States Patent
Wild et al.

(10) Patent No.: US 11,059,039 B2
(45) Date of Patent: Jul. 13, 2021

(54) SMART MICROFLUIDIC MIXING INSTRUMENT AND CARTRIDGES

(71) Applicant: Precision Nanosystems Inc., Vancouver (CA)

(72) Inventors: Andre Wild, Vancouver (CA); Timothy Leaver, Vancouver (CA); Robert James Taylor, Vancouver (CA); Euan Ramsay, Vancouver (CA); Nicolas Klaassen, Vancouver (CA); Shao Fang Shannon Chang, Vancouver (CA); Keara Marshall, Vancouver (CA)

(73) Assignee: Precision NanoSystems Inc., Vancouver (CA)

( * ) Notice: Subject to any disclaimer, the term of this patent is extended or adjusted under 35 U.S.C. 154(b) by 155 days.

(21) Appl. No.: 16/314,941

(22) PCT Filed: Jun. 30, 2017

(86) PCT No.: PCT/CA2017/050802
§ 371 (c)(1),
(2) Date: Jan. 3, 2019

(87) PCT Pub. No.: WO2018/006166
PCT Pub. Date: Jan. 11, 2018

(65) Prior Publication Data

US 2020/0023358 A1 Jan. 23, 2020

Related U.S. Application Data

(60) Provisional application No. 62/359,123, filed on Jul. 6, 2016.

(51) Int. Cl.
*B01L 3/00* (2006.01)
*B01F 13/00* (2006.01)

(52) U.S. Cl.
CPC .... *B01L 3/502715* (2013.01); *B01F 13/0059* (2013.01); *B01F 2215/0037* (2013.01);
(Continued)

(58) Field of Classification Search
CPC .. B01L 3/502715; B01L 3/5027; B01L 3/502; B01L 3/50; B01L 2300/022;
(Continued)

(56) References Cited

U.S. PATENT DOCUMENTS 8,446,021 B2 5/2013 Maeurer et al.
2003/0225362 A1 12/2003 Currie et al.
(Continued)

FOREIGN PATENT DOCUMENTS

CA 2941823 A1 9/2015
WO 2004098768 A1 11/2004
(Continued)

OTHER PUBLICATIONS

Precision Nanosystems: "NanoAssemblr Benchtop Develop Future Nanomedicines" Dec. 31, 2016, Retrieved from https://www.precisionnanosystems.com/docs/default-source/pni-files/brochures/benchtop-brochure_email.pdf.
(Continued)

*Primary Examiner* — Christine T Mui
(74) *Attorney, Agent, or Firm* — Larson & Anderson, LLC

(57) ABSTRACT

A "smart" instrument for mixing (100), a microfluidic chip (50), and a system wherein they are used to prepare formulations is provided. The microfluidic chip comprises microchannels and a programmable data component. The system achieves optimal formulations for RNA, antisense, peptides and small molecules in the hands of even novice users.

18 Claims, 9 Drawing Sheets

(52) U.S. Cl.
CPC ... *B01L 2300/022* (2013.01); *B01L 2300/023* (2013.01); *B01L 2300/024* (2013.01); *B01L 2300/025* (2013.01); *B01L 2300/041* (2013.01)

(58) Field of Classification Search
CPC ..... B01L 2300/021; B01L 2300/02; B01L 2300/00; B01F 13/0059; B01F 13/00; B01F 2215/0037; B01F 2215/0001; B01F 2215/00
USPC ..... 422/502, 500, 50
See application file for complete search history.

(56) References Cited

U.S. PATENT DOCUMENTS

| | | | | |
|---|---|---|---|---|
| 2005/0201901 | A1 | 9/2005 | Grossman et al. | |
| 2007/0077179 | A1 | 4/2007 | Schmalz et al. | |
| 2009/0071829 | A1 | 3/2009 | O'Banion et al. | |
| 2012/0276209 | A1 | 11/2012 | Cullis et al. | |
| 2013/0143328 | A1 | 6/2013 | Peters | |
| 2013/0273643 | A1* | 10/2013 | Vickers | B01L 3/502 435/287.2 |
| 2013/0330245 | A1 | 12/2013 | Duncan et al. | |
| 2014/0328759 | A1 | 11/2014 | Cullis et al. | |
| 2015/0086997 | A1 | 3/2015 | Linder et al. | |
| 2015/0190767 | A1 | 7/2015 | Govyadinov et al. | |
| 2016/0022580 | A1 | 1/2016 | Ramsay et al. | |
| 2016/0214103 | A1 | 7/2016 | Cullis et al. | |
| 2016/0235688 | A1 | 8/2016 | Walsh et al. | |

FOREIGN PATENT DOCUMENTS

| | | | |
|---|---|---|---|
| WO | 2008/014117 | A2 | 1/2008 |
| WO | 2009043614 | A2 | 4/2009 |
| WO | 2016138175 | A1 | 9/2016 |

OTHER PUBLICATIONS

Taylor, J. et al. "Microfluidic-Based Manufacture of RNA-Lipid Nanoparticles for the Development of Genetic Nonmedicines" Abstracts of the 17th Annual Meeting of the American Society of Gene and Cell Therapy, Molecular Therapy, May 2014, p. s222, vol. 22, Suppl. No. 1.

* cited by examiner

SMART MICROFLUIDIC MIXING INSTRUMENT AND CARTRIDGES

BACKGROUND OF THE INVENTION

Field of Invention

The field of the invention is small volume mixers for research materials and pharmaceuticals.

Related Art

Microfluidic mixing incorporates the physics of fluids flowing in small channels to promote self-assembly of nanoparticles that can encapsulate nucleic acids, small molecules, proteins and/or peptides efficiently and with minimal loss of the delicate and expensive materials. The resulting formulations are useful for academic research and medical treatment.

United States Publication Nos. 20120276209 and 20140328759, by Cullis et al. describe methods of using small volume mixing technology and novel formulations derived thereby. United States Publication No. 20160022580 by Ramsay et al. describes more recent advances using small volume mixing technology and products.

In recent years, devices for biological microfluidic mixing have been designed. Precision NanoSystems Inc., in Vancouver, Canada, manufactures and distributes such devices under the NanoAssemblr™ brand. Single use cartridges or microfluidic chips (hereinafter, "m-Chips") are miniaturized, laboratory-ready mixing platforms which work within these devices.

Currently, control of the mixing process on an m-chip is exerted by an operator through machine controls or a manually operated mechanism. Under the direction of the operating technician or "user", these dispense reagents to the inlet in the M-chip at an optimal speed in order to achieve optimal mixing.

The fluidic elements being mixed by researchers are increasingly complex and valuable, and include nucleic acids, peptides, and small molecule drugs. In the laboratory and in the case of personalized medicine, a greater understanding of which lipid/surfactant/drug ratios and particle size are optimal for each drug and tissue target require that large numbers of formulations be prepared and screened, each with specific conditions which must be carefully tracked. Furthermore, the M-chips are so small that a user cannot easily determine whether they are clean or soiled, free flowing or blocked.

There is a need for a semi-automated, quality-controlled microfluidic mixing apparatus, which reduces losses of expensive materials to an absolute minimum, and which enables consistently high quality formulations regardless of the experience of the user.

SUMMARY OF THE INVENTION

According to embodiments of the inventions, there is provided an instrument for mixing, said instrument having a motor, a pump, a microfluidic chip engagement tray incorporating a data transmitter/receiver, a microcontroller, and a user interface. In an embodiment, the data transmitter/receiver includes an RFID reader. In another embodiment, the transmitter/receiver detects the correct positioning of a microfluidic chip on the engagement tray.

In another embodiment, the instrument operates in association with a microfluidic chip comprising a data component.

In another embodiment of the invention, the instrument and microfluidic chip communicate with each other when the microfluidic chip is engaged in the instrument and the instrument is turned on.

According an embodiment of the invention, there is provided a programmable microfluidic chip comprising an inlet, microchannels, an outlet, and a data component.

In another embodiment of the invention the microfluidic chip of claim 1, wherein the data component is a radiofrequency identification tag ("RFID"). In other embodiments, the RFID has a defined readable range. The range is, in some embodiments, from 0 to 50 mm. In other embodiments, the range is 0 to 20 mm. In other embodiments, it is 0 to 5 mm. In another embodiment of the invention, the microfluidic chip is provided with a removable fitted manifold and cover.

In another embodiment of the invention, the data component includes stored data which is readable by, and which directs the behaviour of, an instrument for mixing. In another embodiment of the invention, the stored data includes a status indicator includes historical data of said microfluidic chip.

In another embodiment of the invention, the stored data includes the type or purpose of microfluidic chip.

In another embodiment of the invention, the data component is read by an instrument for mixing, processed by a microcontroller within said instrument, and a corresponding message is communicated to a user via a user interface on the instrument.

In another embodiment of the invention, the data read from the data component dictates what information the instrument sends to the user interface.

In another embodiment of the invention, the data read from the data component of the microfluidic chip contains information which is sent to the user interface and appears to a user as a set of instructions. In another embodiment, the information appears to the user as a set of options.

In another embodiment of the invention, the data component is capable of receiving, storing and emitting data.

According an embodiment of the invention, there is provided a system for formulating a therapeutic agent for research use, the system including an instrument having a pump, a microfluidic chip engagement tray incorporating a data transmitter/receiver, a microcontroller, a memory storage device, and a user interface, as well as an interchangeable microfluidic chip, and wherein the therapeutic agent is selected from the group consisting of nucleic acids, peptides, protein, or hydrophobic small molecules.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
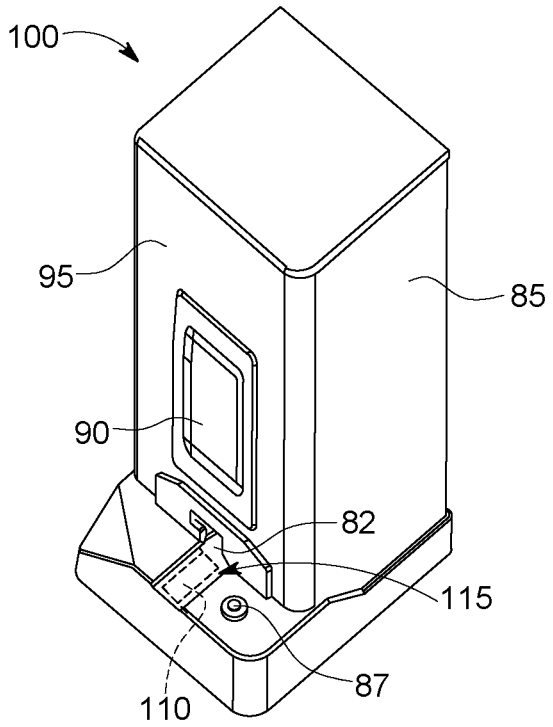
FIG. 1 is an illustration of a perspective view of an microfluidic mixing instrument according to one embodiment of the invention.

In accordance with a first embodiment of the invention, there is provided an microfluidic mixing instrument as generally shown in FIG. 1. Microfluidic mixing instrument comprises a hard shell case 85 having a front face 95, a graphical user interface such as a screen or touchscreen 90, a start button 87, an M-chip entry 82, and a platform 115 with a pressure sensor.

Figure 6:
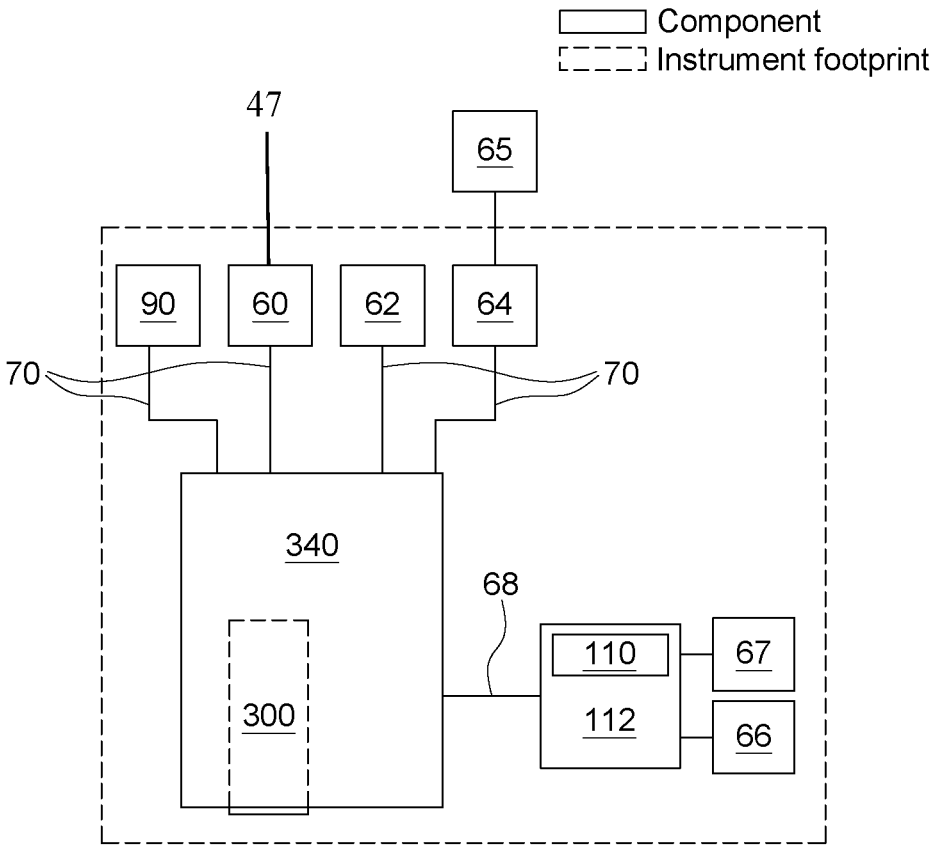
FIG. 6 is an electric block diagram showing the functional units inside the microfluidic mixing instrument. Components are shown with solid outline, instrument footprint by the dotted line.

As illustrated best in FIG. 6, which is a block diagram showing the mechanical and electrical elements and their relationship, the instrument 100 houses a clamp motor 60, a pump motor 62 connected via cabling 70 to main printed circuit board (main "PCB") 340. Main PCB 340 occupies a space inside the hard shell case 85 near the rear of the instrument 100, behind the pump(s) 47. Also connected to PCB 340 via cabling 70 are power switch and jack 64, and power supply 65. One or more independent inlet pumps 47 (not shown) and m-chip engagement clamp, and engagement seal (not shown, but which lower onto m-chip when start is engaged) are connected to motors 62 and 60 mechanically.

Figure 5A:
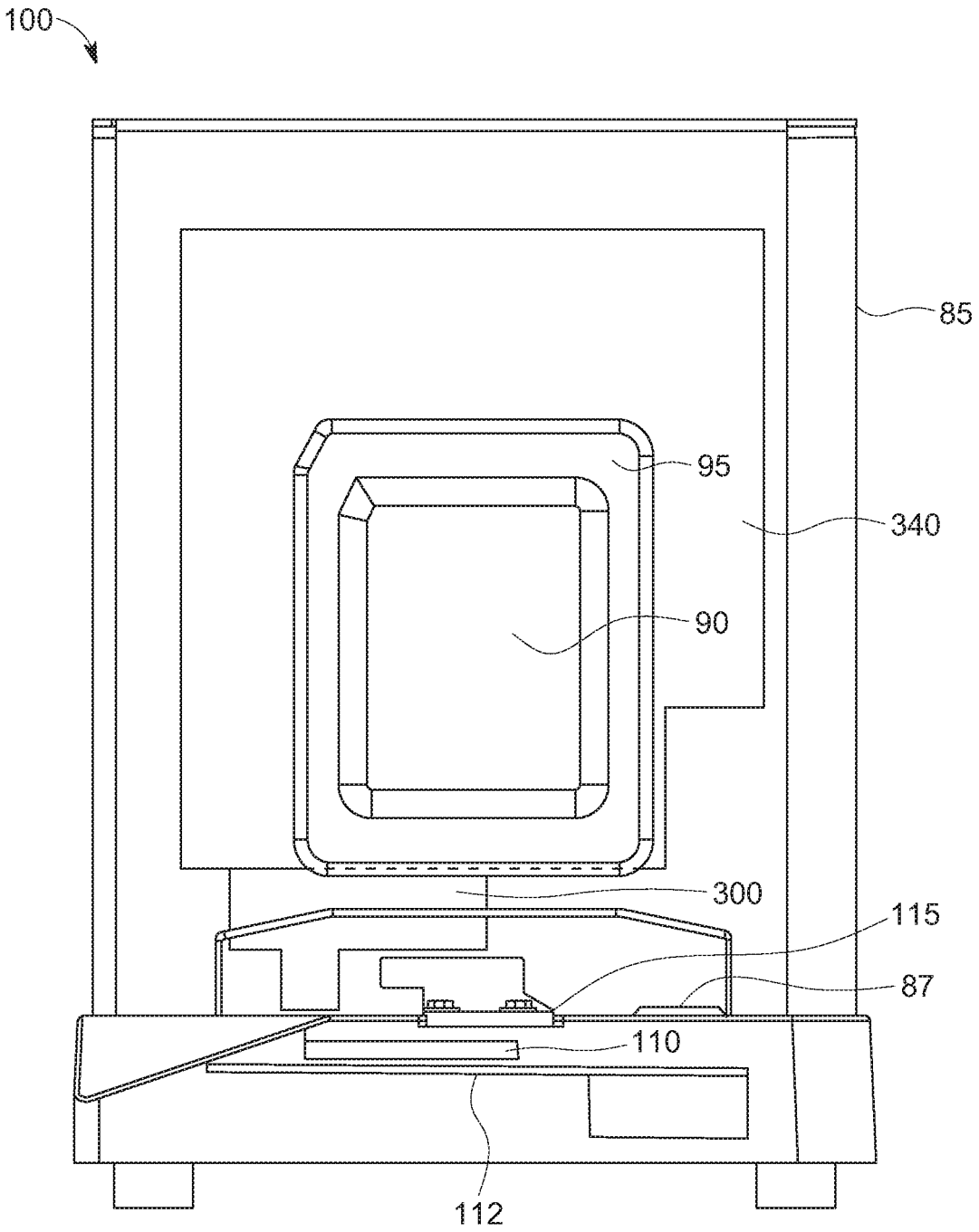
FIG. 5A is an illustration of the location of the main PCB, microcontroller, data emitting sensor reader, and connector within an outline of an embodiment of the microfluidic mixing instrument from the front of the instrument.
Figure 5B:
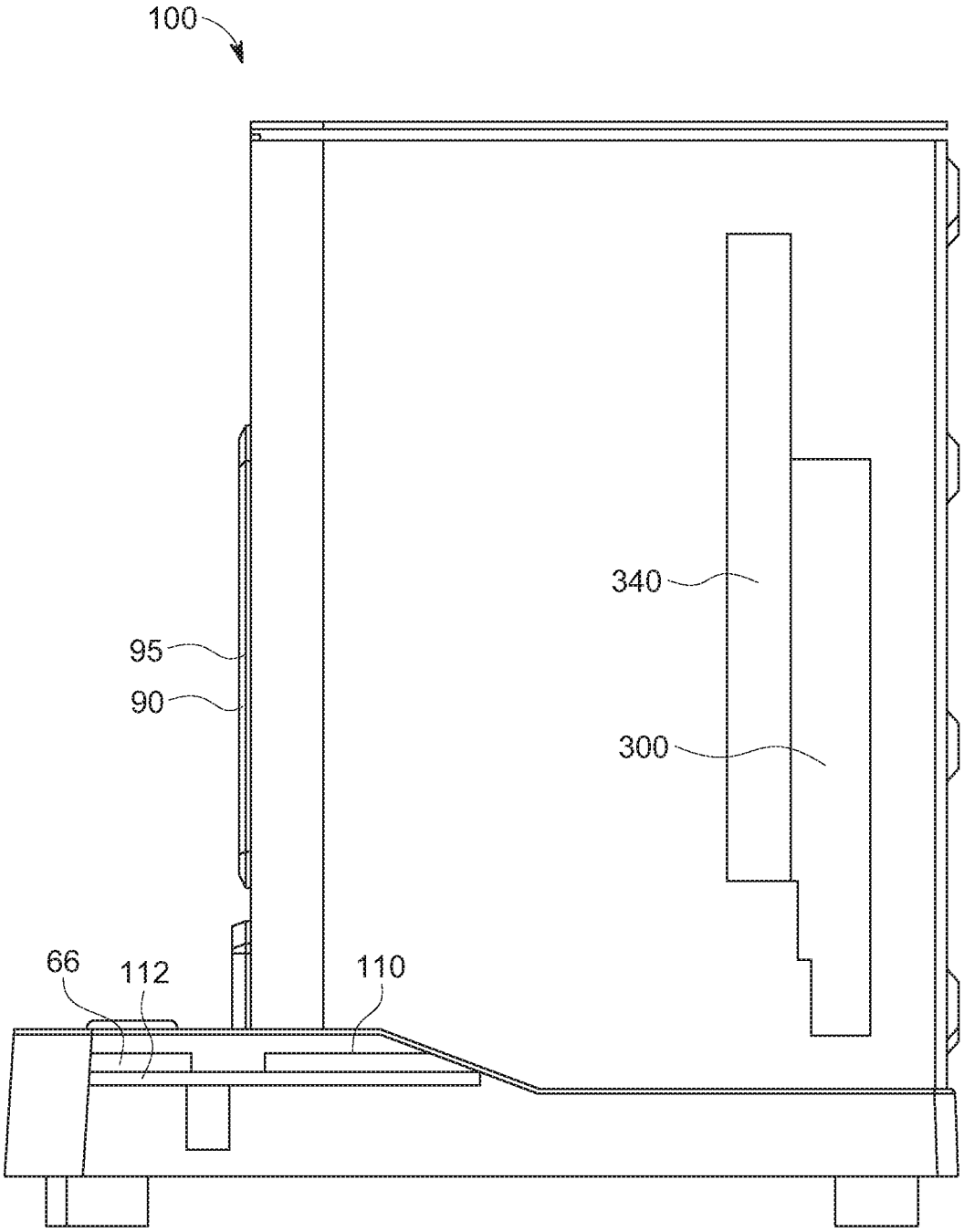
FIG. 5B is an illustration of the same elements as shown in FIG. 5A, but from the right side of the instrument.

FIGS. 5A and 5B are front and side cross section views of the instrument 100 showing locations of main PCB 340, microcontroller 300, and connector 112 in one embodiment. In FIG. 5B, the location of reader 110 and secondary PCB 112 are shown.

Connected to main PCB 340 via ribbon cable connector 68 is reader 110, and the secondary PCB 112. Secondary PCB 112 operates the LEDs associated with m-chip entry 82. Also connected to secondary PCB 112 is cartridge switch 67 and start switch 66. Cartridge switch 67 is engaged to reader 110. Cartridge switch 66 is engaged to start button 87.

Secondary PCB 112 is normally within the base of instrument 100, below platform 115. Turning now to FIG. 5*a*, the general location of the components is shown with respect to position only in the context of an outline of the instrument 100, from the front. Reader 110 is shown under m-chip entry 82.

An on/off power switch is located at the back of the instrument 100 in preferred embodiments.

The data emitting sensor 20 interacts with the instrument 100 reader 110 to accomplish the processes, checking for cartridge, whether used or not, informing user if not, whether the cartridge is compatible with the instrument 100, loading a recipe, prompting user for confirmation, executing process if user indicates yes, indicating success or error outcome, and recording usage data to the tag.

The microcontroller 300 (for example, a microcontroller such as an Atmel™ ATmega2560™ microcontroller, available from any robotics vendor including http://www.canadarobotix.com, www.BC-Robotics.com, https://www.buy-api.ca and many others) coordinates and controls the commands and feedback from and to the other components. In embodiments, microcontroller 300 is a single-board microcontroller used for building digital devices and interactive objects that can sense and control real objects. Main PCB 340 receives and delivers the commands and feedback to and from the other components. Microcontroller 300 is generally placed in front of the PCB 340 and behind the instrument front face 95.

There are one or two motors in preferred embodiments. These are shown only in block diagram form in FIG. 6. The clamp motor 60 acts to lower the independent inlet pump 47 onto the inlet 55 or fitted lid of m-chip 50. Pump motor 62 moves the pump plunger or piston at the prescribed speed. The pump mechanism(s) are direct pumps in preferred embodiments, which pumps impel fluids under controlled pressure through the correctly-seated m-chip 50 as described below. The linear travel per step is the most important specification for the motors. The clamp motor 60 has a value of 0.0003125"/step (0.0079 mm/step) and the pump motor 62 motor is 0.00125"/step (0.0317 mm/step).

Data Component

Figure 2A:
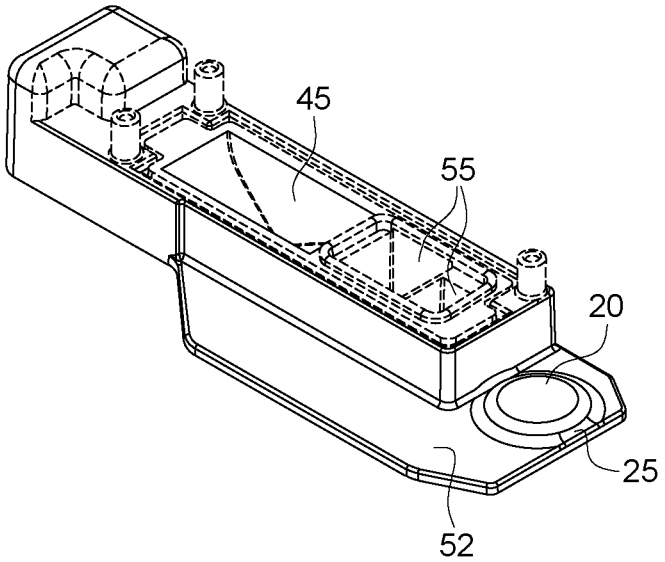
FIG. 2A is an illustration of one embodiment of a microfluidic chip as used for the Spark™ microfluidic mixing instrument, perspective view.
Figure 2B:
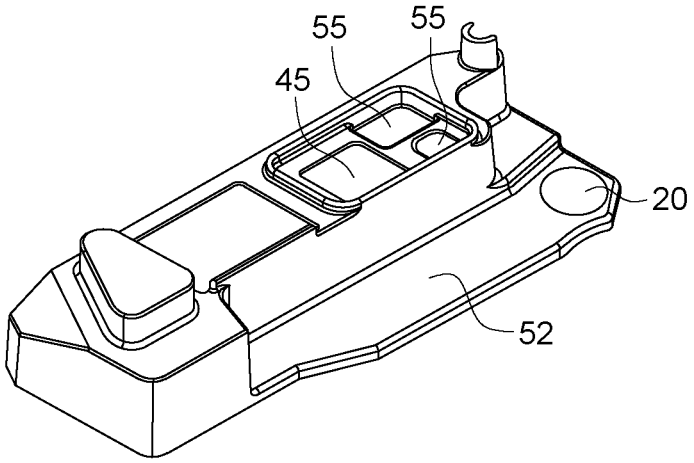
FIG. 2B is an illustration of another embodiment of a microfluidic chip as used for the Spark™ microfluidic mixing instrument, perspective view.
Figure 2C:
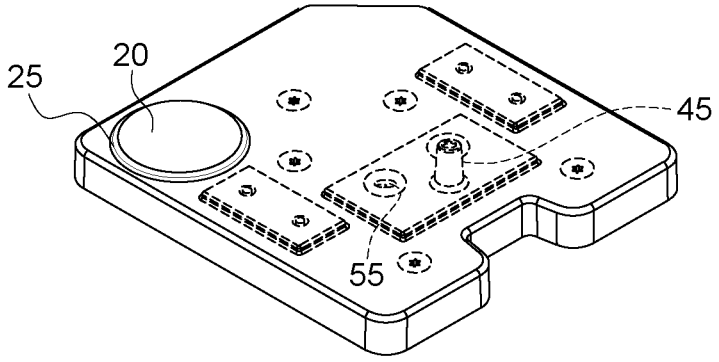
FIG. 2C is an illustration of one embodiment of a microfluidic chip as used for a benchtop mixing instrument, perspective view.

In accordance with a second embodiment of the invention, there is provided an m-chip 50 according to the invention as exemplified by embodiments shown in FIGS. 2A, 2B and 2C.

M-chip 50 is a solid material, such as rigid or semi-rigid plastic, metal or glass, and is manufactured to have inlet 55, microchannels with micromixing geometries, outlet 45, and a data component 20. M-chip 50 possesses strength and surfaces for a clamp to secure it into position and to allow an inlet pump 47 (not shown) to seal to inlet 55, in some embodiments in the form of a custom fitted lid that is placed on the m-chip 50 after reagents are added to inlet 55. In some embodiments, m-chips have a side flange 52 for stability and user manipulation. These are not necessary for the operation of the m-chip, but are added for convenience for the user.

When correctly positioned in the instrument 100, m-chip 50 microchannels are hydraulically connected to the instrument pump(s) 47 which impels the flow of reagents from inlet 55 into microchannels via positive displacement, or by controlled pressurization of the inlet reservoirs 55 integrated within the chip 50 (shown for example in FIG. 2A).

Figure 4A:
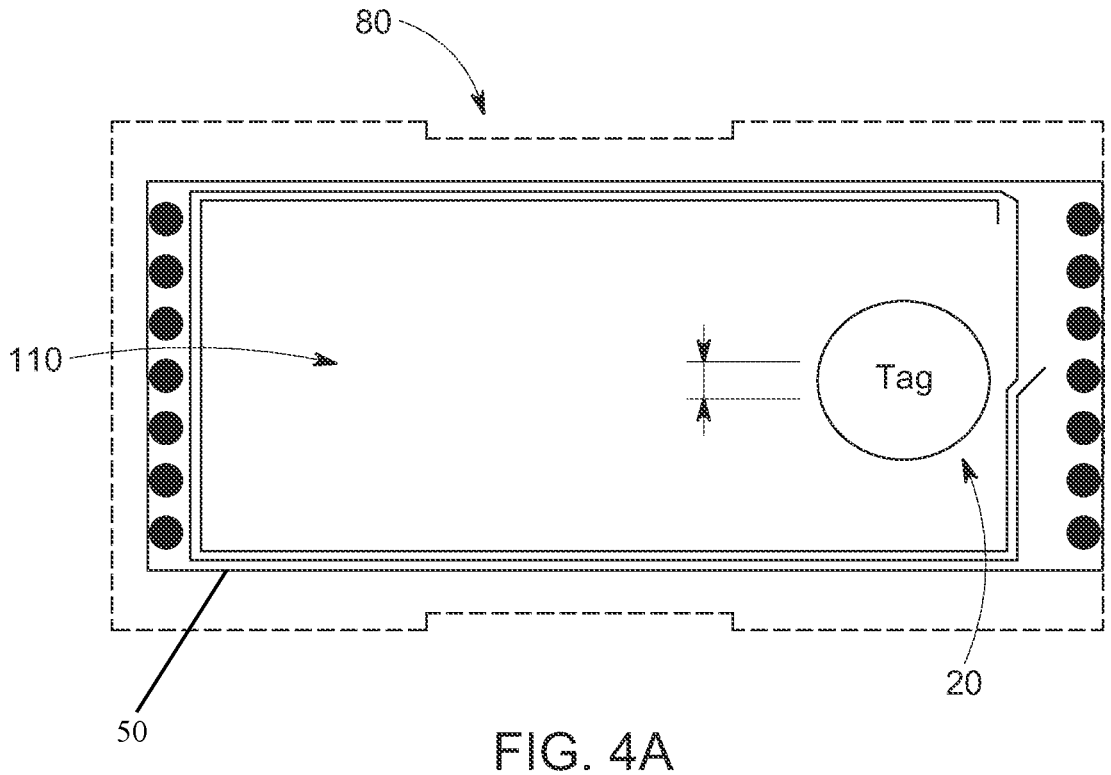
FIG. 4A is an illustration of size ratios of an RFID tag on an M-chip, and the data signal range of each as related to the Reader. The readable height and range of signal height are indicated by dashed lines, readable range of underlying Reader is indicated as a long rectangle.
Figure 4B:
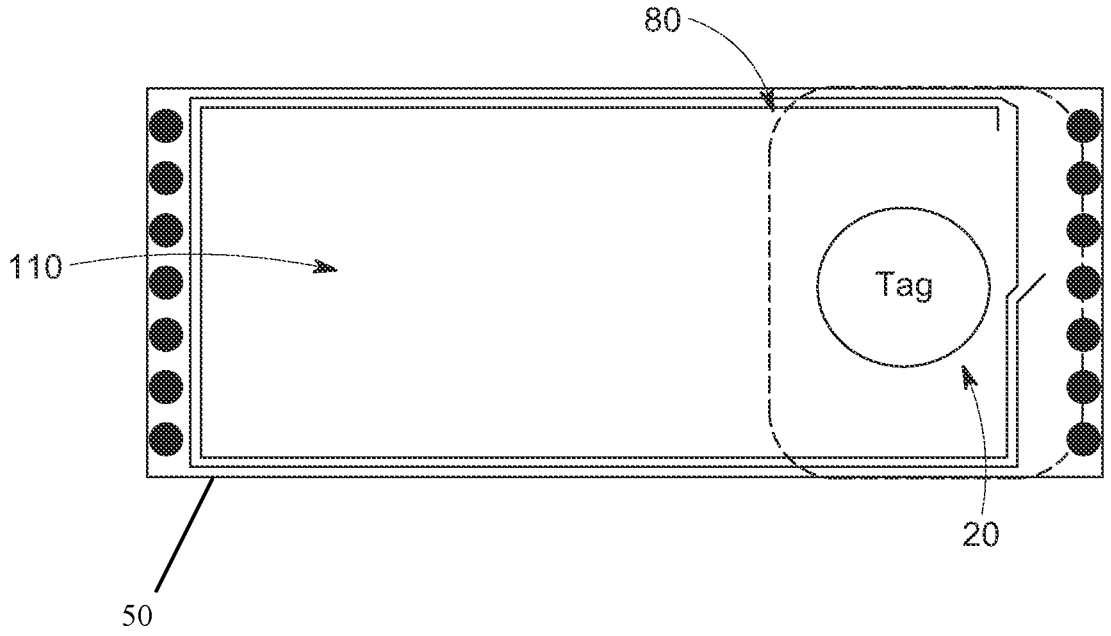
FIG. 4B is an illustration of another embodiment of RFID tag placement as related to the Reader, and the data signal. The readable height and range of signal height are indicated by dashed lines.
Figure 4C:
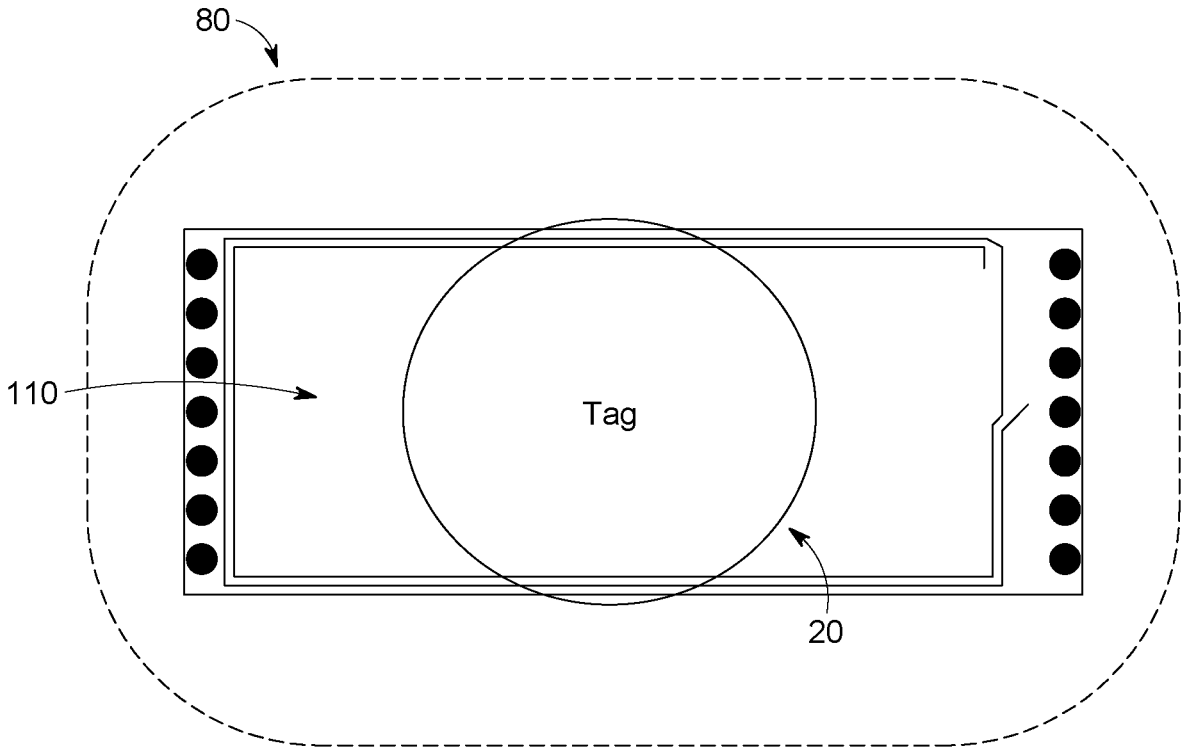
FIG. 4C is an illustration of another embodiment of RFID tag as related to the Reader, and the data signal. The readable height and range of signal height are indicated by dashed lines, but are oval rather than rectangular in practice.

As referred to above, the M-chip 50 in FIGS. 4A, 4B and 4C includes an inlet 55, with two wells in preferred embodiments, for fluidic elements to be aliquoted, and at least one outlet 45. The fluidic elements for mixing can be lipids, surfactants, water-soluble and water insoluble materials for formulation, buffers and excipients. From the outlet 45, the operator or instrument draws the resultant mixture into whatever container is appropriate.

Hydraulics

Syringe pumps are used in one embodiment, one per inlet. In some embodiments, there are two inlets 55 and there are engaged by separate pumps so that reagents from each inlet 55 are separately driven (at different speeds, for example).

A microchannel is defined as a channel with a hydraulic diameter of below 1 mm. "Mixing geometries" are known in the art, and include herringbone and other patterns of microchannels, examples of which are disclosed in United States Patent Publication Nos. US20120276209A1, US20160214103A1, US20160235688A1, and PCT publication No. WO2016138175A1. In some embodiments, the data component 20 rests in a tag recess 25 in the m-chip 50 to reduce the risk of tampering or breakage. "Mixing" is meant to include any action wherein two or more materials are combined.

Data Emitting Sensor

Data emitting sensor 20 is embedded or adhered to an m-chip 50, has a sensitive range 80, and interacts with a data receiver 110. Sources for data emitting sensors are any electronics vendors online. The tags 20 are programmed using simple computer language and installed in m-chip 50 by hand, in some embodiments. In alternate embodiments, the tag 20 is manufactured into the m-chip and programmed after manufacture. In another embodiment the tag 20 is pre-programmed and manufactured into the m-chip after that.

In preferred embodiments, data emitting sensor 20 is an RFID tag.

Generally, RFID tags or radiofrequency identification tags are embedded with a transmitter and a receiver. The RFID component according to embodiments of the tags 20 has a chip that stores and processes information, and an antenna to receive and transmit a signal. The tag encodes the unique serial number for a specific m-chip 50, and certain characteristics can be programed in.

The RFID tags 20 used in some embodiments of the invention are passive, in that they use the reader's radio wave energy to relay their stored data back to the reader 110. In other embodiments, a powered RFID tag is embedded with a small battery that powers the relay of information.

The interaction of tag 20 with microfluidic mixing instrument as shown generally in FIGS. 4A, 4B and 4C, in relation to an outline of reader 110, integrated within an operating instrument 100. The range 80 of each tag 20 is customized to the model of instrument 100. The area in which the data emitting sensor tag must be positioned to be successfully read is indicated by the dashed lines, which represent 80, or the signal range. The vertical separation of 4.5 mm between the reader and tag is not apparent from FIG. 4A, but this distance works with the 7.5 mm size tag shown and affects the signal range 80. This embodiment is useful for the smallest instruments 100.

FIG. 4B depicts an RFID reader module 110 which may be integrated within an operating instrument with a corresponding 7.5 mm RFID tag (labelled). The readable area is reduced by increasing the vertical separation between the reader and task to 6.7 mm in this instance.

FIG. 4C shows an embodiment of the m-chip 50 used in a larger volume instrument (a NanoAssemblr™ benchtop) than the m-chips shown in FIGS. 4A and 4B, which are designed for a Spark™ small volume mixer. The principal functions are identical among the three shown embodiments 4A, 4B, and 4C. Tag 20 is larger in the embodiment shown in 2C, which is also reflected in FIG. 4C, because the Reader 110 in the benchtop has a different reception area.

Figure 3:
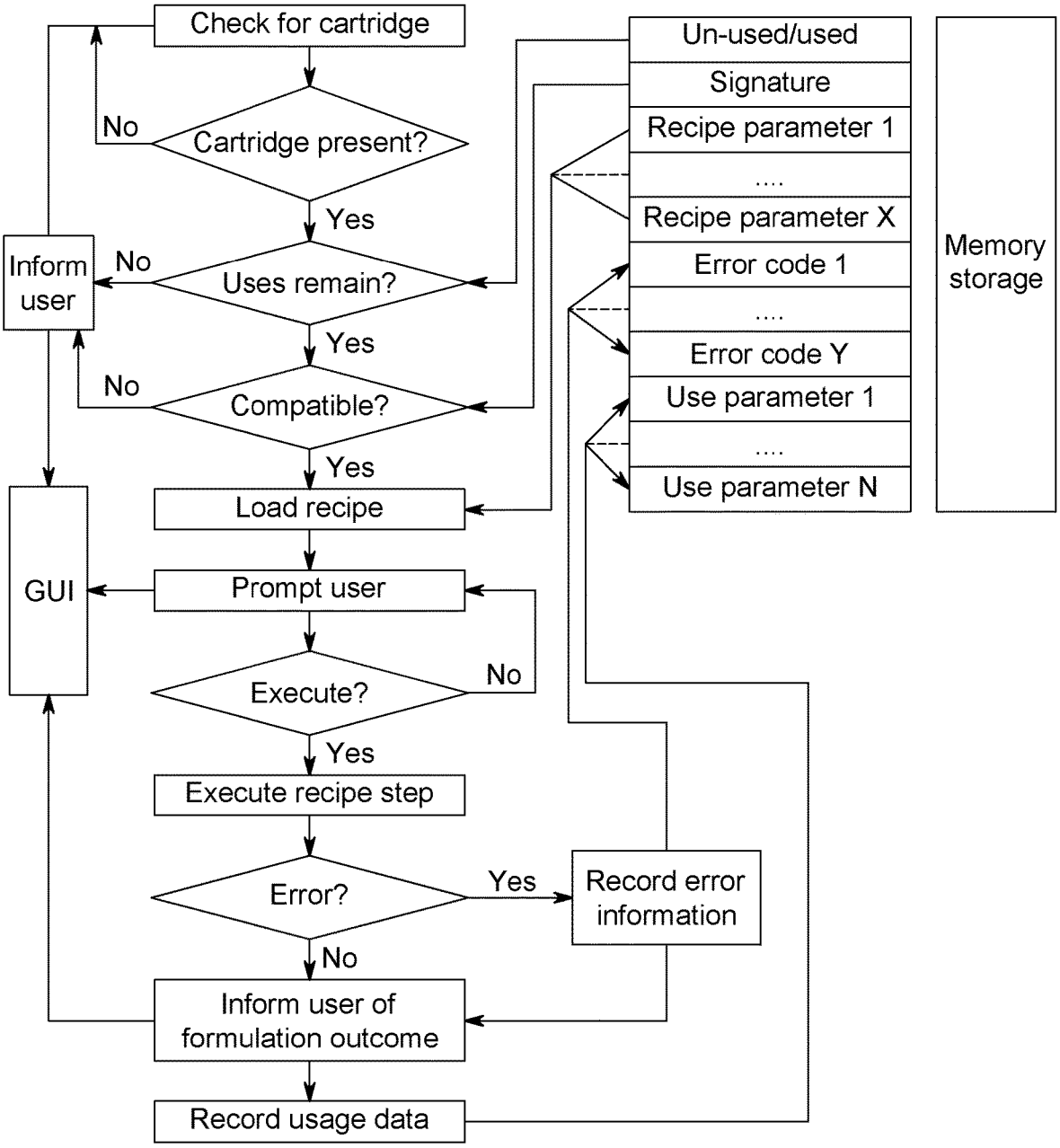
FIG. 3 is a flow chart showing the direction of information going to and from the data emitting sensor tag and data reader, and the resulting action taken by the mixing instrument. Bold lines indicate the process flow and thin lines indicate data flow (arrows indicate direction)

The interaction between tag 20 and reader 110 is unidirectional is some embodiments, or bidirectional in preferred embodiments. FIG. 3 is a flow chart illustrating the queries and communications that go on between the data emitting sensor 20 on the m-chip 50, and the reader 110, and what information is passed on to the graphical user interface 90. The right most columns of the flow chart are characteristics of data emitting sensor 20. The control and coordination particularly in the central column of actions in FIG. 3 are attributable to the microcontroller 300 commanding main PCB 340. Microcontroller 300 communicates with and coordinates the graphical user interface (GUI) 90, obtains feedback from GUI and pressure sensor on platform 115, start button 87, and motors 60 and 62.

In one embodiment, data emitting sensor 20 may include data in the form of an integer count, binary flag, defined character, string or equivalent to indicate whether or not it has been previously used and if so, how many times it has been used or how many uses remain. Such an application is valuable at occasions when the number of uses, including single-use, of an m-chip 50 requires enforcement for either regulatory or licensing reasons. Specifically in microfluidics, the presence of small channels which cannot be easily visualized may result in a condition where an m-chip 50 appears "clean" and usable to an operator, but in fact small amount of material (such as nucleic acids, salts, proteins or other molecules) representing cross-contamination between runs may be present. Additionally, use of the m-chip 50 may cause microscopic damage, not apparent to the operator, which would compromise future experiments carried out on said device 50.

In one embodiment, the m-chip 50 may contain a means of storing a set of instructions for the instrument to carry out on an inserted m-chip 50. This may include instrument settings such as temperatures, delay times, pressure values or any other parameter which could conceivably be incorporated onto an electromechanical instrument. In one embodiment, after an m-chip 50 is inserted into the instrument the recipe would be read and either executed (with or without a user prompt or warning). Such a configuration would be attractive in many scenarios. In one situation, a manufacturer may provide m-chip 50*s* as part of a larger kit where different kits may perform different tasks using the same m-chip. In this situation, a stored recipe allows the manufacturer to produce only one type of m-chip 50 but load a different recipe depending on which kit it will be bundled with. This approach reduces the likelihood of the error versus one where the operator would have to enter or select a recipe on the instrument. Additionally, this approach allows the manufacturer to update recipes or release new ones without having to perform updates to instruments deployed in the field. In a further embodiment, the m-chip 50 may contain multiple recipes, each with a corresponding signature which is recognized by the instrument, thus enabling the m-chip 50*s* to be backwards and cross-compatible with instruments containing different software or hardware versions.

Thus, in embodiments, recording usage data can be achieved with a writeable RFID tag 20 containing a defined section of memory with a flag which the instrument 100 may switch on to indicate that the m-chip 50 has been used. If re-use is permissible for a certain number of times under a particular licensing or regulatory condition, a block of memory is used to store how many more times the m-chip 50 may be used or how many uses remain.

In embodiments of the invention, the RFID tag 20 contains a memory for storing a set of instructions for the instrument to carry out on an inserted m-chip 50. This may include instrument settings such as temperatures, delay times, pressure values, flow rates, speed or distance of movement of actuators, or any other parameter which could conceivably be incorporated onto an electromechanical instrument. In one embodiment, after an m-chip 50 is inserted into the microfluidic mixing instrument, the recipe would be read and executed with or without further user action. In such an embodiment, a cartridge may be provided with one or more embedded or pre-loaded reagents for which the corresponding recipe may be programmed onto the cartridge to avoid error and to simplify the workflow of the operator.

This approach reduces the likelihood of user error. Additionally, the system of the invention allows the manufacturer to update recipes or release new ones without having to perform updates to instruments deployed in the field. In a further embodiment, the m-chip 50 may contain multiple recipes, each with a corresponding signature which is recognized by the instrument 100, even enabling the m-chips 50 to be backwards and cross-compatible with instruments containing different software or hardware versions.

In certain embodiments, the instrument 100 may record data onto the m-chip 50. In one embodiment, if a fault occurs during operation, the instrument records items such as error codes, instrument settings, sensor readings etc. onto the m-chip. In this way, if the m-chip 50 is presented to the manufacturer or their representative, the information is read in order to diagnose the fault.

In one embodiment, a specially programmed m-chip 50 contains data to update the settings, parameters or other information on the instrument. In such an embodiment, once the m-chip 50 is read, the data on the instrument will be updated to the new value for future uses with standard microfluidic cartridges.

In one embodiment, the instrument may adapt its behaviour based on the information read from the m-chip 50. Different recipes or settings present on the m-chip 50 may require different interfaces, options, parameters, indicators etc. to be presented to the operator. In a further embodiment, the chip may contain data which is or is used to generate steps for the operator to follow (for example, what volumes to load onto the chip) such that is the operator taps the chip on the instrument, the instrument guides the operator through the steps of a recipe.

In some embodiments, the reader 110 is a two-way radio transmitter-receiver, whose location in the Instrument is indicated in FIG. 1 at 110. Its function is to work with the tag 20 to assess m-chip 50 positioning for correctness, m-chip use status, and finally m-chip programming. Reader 110 is able write to, as well as read from, data emitting sensor 20.

For example, when instrument is switched on (power switch on rear of machine), and when an m-chip 50 is inserted into chip entry 82 along platform 115, a pressure sensor on platform 115 provides a signal to cartridge switch 67, which signals the reader 110 to emit a signal to the tag 20 using a built in antenna.

Correct placement and orientation of m-chip 50 is guided by the pressure sensor primarily, then by the tag 20 interacting with reader 110 for fine tuning, which is dependent on the specific range of the data signal range 80 as illustrated in FIGS. 4A-4C as areas bounded by dashed lines. The signal range 80 is selected to be specific to the outline and profile of the m-chip, and is how the m-chip interactions with instrument to be positioned and identified. Depending on the size of the mixing instrument 100, the readable range 80 is from 0 to 50 mm, or 0 to 20 mm, or 0 to 5 mm.

The tag 20 responds to reader 110 with the information written in tag 20 memory.

The logical pattern embodied in the m-chip and instrument of the invention, and their interaction with each other, is illustrated in FIG. 3 in a flow chart format. The reader 110 transmits the read results to microcontroller 300 within the instrument 100. The microcontroller 300 communicates via a ribbon cable connector 68 to main PCB 340, which, in response, causes the GUI 90 to transmit a prerecorded image such as the following examples:

"Cartridge detected! Neuro9™ siRNA
248 uL total volume
Press button below to start formulation"

If the m-chip is not detected on platform 115:

"Please insert a new cartridge below"

or if m-chip is detected on platform 115, but not properly positioned:

"No cartridge detected! Please insert a cartridge below"

The menu screen allows the user to select a mode.

"MODE: Auto Kit Formulation Purge"

If an m-chip is not the right type for the MODE selected by user on the GUI 90, "Wrong Cartridge! This cartridge is meant for kit mode."

Or

"Wrong Cartridge! This cartridge is meant for formulation mode."

If the m-chip has been used already:

"Cartridge has been used already!"

The exact wording can be updated in each chip manufacture. It should be noted that this is a great advance over the prior art instrument and microfluidic chip use, during which information was not available to user on the success or failure of a chip and its formulation.

Figure 7:
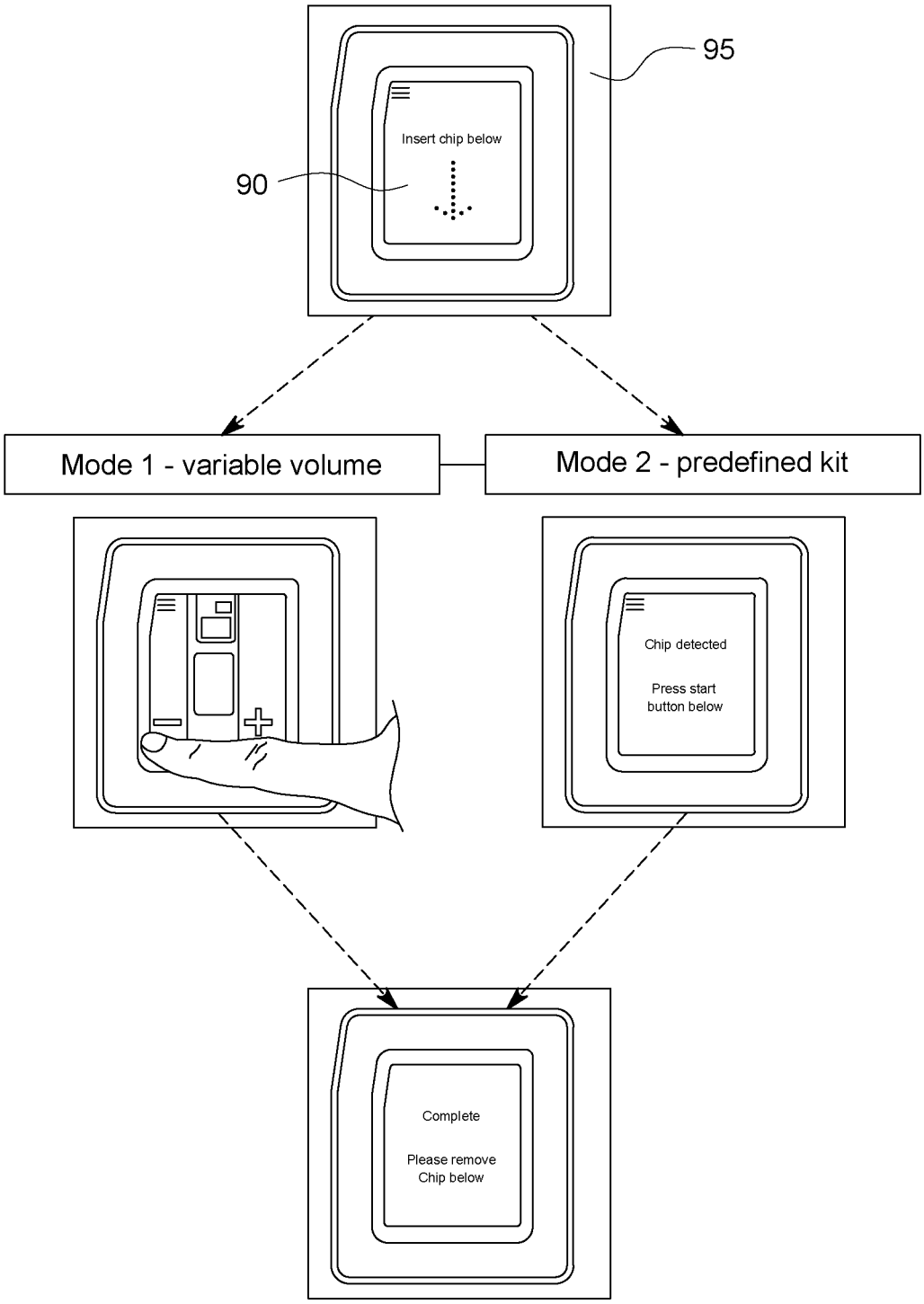
FIG. 7 is a series of photographs of the graphical user interface displayed on a Spark™ microfluidic mixing instrument, depicting the greeting screen, the user controlled Mode 1 screen, the Mode 2 screen for predefined flow rate ratio kits, and the "complete" screen which indicates the formulation is complete.

FIG. 7 illustrates four different screen shots from the graphical user interface 90, depicting what information is read from the m-chip 50. In this example, a prototype NanoAssemblr™ Spark™ small volume mixer instrument (Precision NanoSystems Inc., Vancouver, BC) displays a menu screen, then one of two different screens depending on what Mode of m-chip is inserted. On the left, in Formulation Mode, the user is prompted to enter her formulation volume. In Mode 2, no parameters are variable and the operator is merely prompted to initiate the pre-defined recipe sequence, so on the right, the GUI simply states that the m-chip is detected, and invites the user to press the start button 87 when ready (see FIG. 1 for overall view). The bottom screen reads "Complete" and invites user to remove the m-chip and use the formulation.

The instrument 100 selects the appropriate information to display on its GUI 90 based on data emitting sensor 20 data.

Thus this disclosure is directed towards a disposable cartridge containing an m-chip 50 and an embedded data emitting component, such as an RFID tag 20, to store data. By using this cartridge with an accompanying scientific instrument, together referred to as a system, information can be transferred in both directions (read from the m-chip 50 to the instrument or written by the instrument onto the m-chip 50 at tag 20) to facilitate ease of use, software updates, troubleshooting, and end user licensing among other tasks. Various embodiments are described below which is used independently or combined to form further embodiments.

Example 1: M-Chip Manufacture

RFID 20 is used as means to store and read data on an m-chip 50. In one such instance, an RFID reader 110 was embedded inside of a NanoAssemblr™ Spark™ laboratory research instrument 100. In this specific case, a DLP-RFID2 (DLP Design, Allen, Tex.) reader (#+1) was attached to the underside of the instrument's microfluidic cartridge receiving tray 115. This reader was positioned such that a 7.5 mm RFID tag (meeting the specifications of ISO/IEC 15693. (Verigenics, Southampton, Pa.) installed on the front, underside of a Spark™ m-chip 50 was successfully read when properly inserted and positioned within the Spark. The RFID reader 110 was directly connected to the instrument's internal microcontroller (#+2) in such a way as to communicate using industry standard protocols.

During m-chip 50 manufacturing, the RFID tag 20 was affixed to a recess 25 on the front, underside of an m-chip 50 using a double-sided adhesive film. The RFID 20 was programmed using standard techniques for programming such a tag (method may vary, but vendors provide standard instructions or software). A simple handheld programming device is used to program the tags in this example.

Example 2: Specific Information on Data Emitting Sensor Memory Block

The m-chip 50 was programmed to run a specific set of parameters required to formulate 2 nmol of siRNA into lipid nanoparticles for delivery to neurons in vitro.

Data to be stored on the RFID tag was loaded onto a host computer in the form of a .csv file. The host computer broke this data into 8-byte blocks that were written to an RFID tag one at a time. The host computer sent a Write Block command, with one block of data, to the RFID read/write module via an RS-232 serial connection. The RFID read/write module generated an electromagnetic field to power and communicate with an RFID tag according to the ISO-15693 standard.

The module sent out the Write Block command. If an RFID tag was within range of the module's antenna, the tag stores the block of data into non-volatile internal memory and responds to the RFID module with a Success code. The RFID module waited for a tag response, and then reported back to the host computer about whether the write was successful.

Steps 4-7 were repeated until all of the data was sent to the RFID tag and stored.

A pass-fail scenario that was programmed into the chip provided error codes simply stating the following:

ST01: no chip inserted.

ST02: used chip inserted

ST03: wrong chip for current mode, kit chip in formulation mode

ST04: wrong chip for current mode, formulation chip in kit mode

ST05: chip inserted while purging

ST06: can't read chip, no RFID header

ST07: can't read chip, bad checksum

Example 3: Formulating Nucleic Acid

To formulate using a Spark™ mixing instrument, the operator used an m-chip as shown in FIG. 2A. Formulation buffer was dispensed into outlet well, the siRNA (Integrated DNA Technologies, Coralville, Iowa) in aqueous solution (Neuro9 Spark Kit™, Precision NanoSystems Inc., Vancouver, BC) into one well of the m-chip inlet, and lipid nanoparticle solution in ethanol (see Ramsay et al, supra) into the second inlet. A manifold and cover was placed over the m-chip, and the covered m-chip was then inserted into the Spark™ micromixer. Upon insertion, the instrument read the information on the RFID tag, confirmed it was compatible and unused, and presented the operator with a statement on the instrument's screen confirming the type of formulation that the m-chip had been programmed for, and instructed her to press "Start" when ready to proceed.

The instrument then ran the formulation as per the parameters stored on the RFID tag. After the formulating process was successfully completed, the data on the tag was updated by the reader in the Spark™ to indicate that the m-chip had been used.

After formulation, the operator removed the m-chip from the instrument, removed the cap and manifold and pipetted out the resultant formulation from the outlet well. The m-chip 50 (with corresponding tag) was then disposed of according to local regulations.

Example 4: Advanced Smart M-Chip Programming

An m-chip is prepared as in Examples 1 and 2, but error codes include:

ST08: flow rate error

ST09: pressure error

If an error had occurred during formulation, such as a loss of pressure, a corresponding error code or message would have been displayed to the operator and written to the RFID tag.

Enhanced feedback from Instrument to tag, and vice versa, includes pressure losses, unexpected resistance, or unexpected lack of resistance, These enhanced data are included in the GUI readout to inform user of further exceptions. These exceptions can help diagnose mechanical issues with the instrument, which will help with repair of the instrument.

While specific embodiments of the invention have been described and illustrated, such embodiments should be considered illustrative of the invention only and not as limiting the invention as construed in accordance with the accompanying claim.

What is claimed is:

1. An instrument (100) for mixing, for use in association with a microfluidic chip (50) comprising a data component (20), said instrument (100) having a motor (62), a pump (47), a microfluidic chip engagement tray (115) incorporating a two-way data transmitter-receiver (110), a microcontroller (300), and a user interface (90), wherein the instrument (100) is configured to record data onto said data component (20) of said microfluidic chip (50) during use, wherein said data comprises one or more of:

(a) an indication that said microfluidic chip (50) has been used;

(b) an indication of how many more times said microfluidic chip (50) may be used; and (c) information for diagnosing a fault, wherein said instrument (100) is configured to record said information onto said data component (20) of said microfluidic chip (50) when a fault occurs during mixing.

2. The instrument of claim 1, wherein said data transmitter-receiver (110) includes an RFID reader.

3. The instrument of claim 1, wherein said data transmitter-receiver (110) is configured to detect the correct positioning of said microfluidic chip (50) on the engagement tray (115), wherein the correct positioning of said microfluidic chip (50) is detected by interaction of the data transmitter-receiver (110) with said data component (20) of said microfluidic chip (50).

4. The instrument of claim 1, wherein said information for diagnosing a fault comprises one or more of an error code, an instrument setting and a sensor reading.

5. A programmable microfluidic chip (50) for mixing comprising an inlet (55), microchannels, an outlet (45) for drawing the resultant mixture from the programmable microfluidic chip (50), and a data component (20), wherein said data component (20) is a radiofrequency identification tag ("RFID") comprising a defined section of memory with a flag configured to be switched on by an instrument (100) for mixing to indicate that the programmable microfluidic chip (50) has been used.

6. The microfluidic chip (50) of claim 5, wherein said RFID has a defined readable range of from 0 to 5 mm.

7. The microfluidic chip (50) of claim 5, wherein said RFID has a defined readable range of from 0 to 20 mm.

8. The microfluidic chip (50) of claim 5, wherein said RFID has a defined readable range of from 0 to 50 mm.

9. The microfluidic chip (50) of claim 5, wherein the microfluidic chip (50) includes a removable fitted manifold and cover.

10. The microfluidic chip (50) of claim 5, wherein the data component (20) includes stored data which is readable, and which directs action of, the instrument (100) for mixing.

11. The microfluidic chip (50) of claim 10, wherein said stored data includes a status indicator including historical data of said microfluidic chip (50).

12. The microfluidic chip (50) of claim 10, wherein the stored data includes a type or a purpose of the microfluidic chip (50).

13. The microfluidic chip (50) of claim 5, wherein the data component (20) is configured to be read by the instrument (100) of claim 1, processed by the microcontroller (300) within said instrument (100), and cause a corresponding message is communicated to a user via the user interface (90) on the instrument (100).

14. The microfluidic chip (50) of claim 13, wherein the data read from the data component (20) is configured to dictate what information the instrument (100) sends to the user interface (90).

15. The microfluidic chip (50) of claim 12, wherein the data read from the data component (20) contains information that is configured to be sent to the user interface (90) and appears to a user as a set of instructions or options.

16. The microfluidic chip (50) of claim 5, wherein the data read from the data component contains information that is sent to the user interface and appears to a user as a set of options.

17. The microfluidic chip (50) of claim 5, wherein the data component (20) is capable of receiving, storing and emitting data.

18. A system for formulating a therapeutic agent for research use, the system comprising an instrument (100) for mixing according to claim 1, as well as a disposable cartridge comprising an interchangeable microfluidic chip (50) comprising a data component (20), and wherein the therapeutic agent is selected from the group consisting of nucleic acids, peptides, protein, or hydrophobic small molecules.

* * * * *